US010358331B2

(12) United States Patent
Lombardo et al.

(10) Patent No.: US 10,358,331 B2
(45) Date of Patent: Jul. 23, 2019

(54) WORK PLATFORM WITH PROTECTION AGAINST SUSTAINED INVOLUNTARY OPERATION

(71) Applicant: JLG Industries, Inc., McConnellsburg, PA (US)

(72) Inventors: David W. Lombardo, Walkersville, MD (US); Ignacy Puszkiewicz, Hagerstown, MD (US)

(73) Assignee: JLG INDUSTRIES, INC., McConnellsburg, PA (US)

( * ) Notice: Subject to any disclaimer, the term of this patent is extended or adjusted under 35 U.S.C. 154(b) by 208 days.

(21) Appl. No.: 14/950,845

(22) Filed: Nov. 24, 2015

(65) Prior Publication Data

US 2016/0075543 A1 Mar. 17, 2016

Related U.S. Application Data

(63) Continuation-in-part of application No. 13/885,720, filed as application No. PCT/US2011/066122 on Dec. 20, 2011, now Pat. No. 9,586,799.

(Continued)

(51) Int. Cl.
*B66F 17/00* (2006.01)
*B66F 11/04* (2006.01)

(52) U.S. Cl.
CPC ..... *B66F 17/006* (2013.01); *B66F 11/044* (2013.01)

(58) Field of Classification Search
CPC ..... B66F 17/006; B66F 17/00; B66B 5/0031; E04G 3/32; E04G 21/24
See application file for complete search history.

(56) References Cited

U.S. PATENT DOCUMENTS 4,754,840 A 7/1988 MacDonald
4,917,213 A 4/1990 Kessler
(Continued)

FOREIGN PATENT DOCUMENTS

CN 2934193 8/2007
CN 201665512 12/2010
(Continued)

OTHER PUBLICATIONS

Australian Patent Examination Report No. 1 dated Mar. 31, 2015 issued in Australian Patent Application No. 2011349306, 3 pp.
(Continued)

*Primary Examiner* — Daniel P Cahn
(74) *Attorney, Agent, or Firm* — Nixon & Vanderhye P.C.

(57) ABSTRACT

An aerial work platform includes a control panel with operator controls for manipulating the platform, a control module communicating with the operator controls and controlling manipulation of the platform based on signals from the control panel, and an obstruction sensing system. The obstruction sensing system includes a sensor mounted in a vicinity of the platform that monitors an operator area, the platform, and an area around the platform. A processor processes the signal to determine a position of an operator on the platform and a proximity of objects in the area around the platform. The control module is in communication with the processor and is programmed to control the manipulation of the platform or machine based on signals from the processor and input from the operator.

16 Claims, 17 Drawing Sheets

FIG. 3

Related U.S. Application Data

(60) Provisional application No. 61/435,558, filed on Jan. 24, 2011, provisional application No. 61/424,888, filed on Dec. 20, 2010.

(56) References Cited

U.S. PATENT DOCUMENTS 4,979,588 A 12/1990 Pike et al.
5,740,887 A * 4/1998 Unger ..... B66F 11/04 180/65.51
5,992,562 A * 11/1999 Boeckman ..... B66F 11/042 182/63.1
6,065,565 A 5/2000 Puszkiewicz
6,595,330 B1 7/2003 Henrickson et al.
6,823,964 B2 11/2004 Goode
6,842,684 B1 * 1/2005 Kade ..... B60K 31/0008 477/182
6,880,187 B1 4/2005 Johnson
7,397,351 B1 * 7/2008 Rubin ..... B60Q 9/008 324/457
8,813,910 B2 8/2014 Bowden
9,022,160 B2 * 5/2015 Smith ..... B60H 1/00407 180/273
9,243,412 B1 1/2016 Gallette
9,586,799 B2 3/2017 Hao
9,676,602 B2 6/2017 Cummings
9,776,847 B2 10/2017 Mondal
9,783,086 B2 * 10/2017 Parker ..... B60N 2/39
2003/0172598 A1 9/2003 Greer
2004/0173404 A1 9/2004 Kobel
2005/0187712 A1 * 8/2005 Callaghan
2005/0224439 A1 10/2005 Bean
2007/0154063 A1 * 7/2007 Breed ..... B60N 2/028 382/100
2008/0142713 A1 * 6/2008 Breed ..... B60N 2/002 250/330
2008/0144944 A1 * 6/2008 Breed ..... G06K 9/00369 382/224
2008/0262682 A1 * 10/2008 Bergsten ..... B60T 8/1766 701/50
2009/0260920 A1 10/2009 Cummings
2010/0068018 A1 3/2010 Maguin
2010/0200332 A1 4/2010 Bowden
2010/0114405 A1 * 5/2010 Elston ..... B66F 9/0755 701/2
2010/0133043 A1 6/2010 Black et al.
2010/0219018 A1 * 9/2010 Knaak ..... B66F 11/04 182/129
2010/0289662 A1 * 11/2010 Dasilva ..... F16P 3/147 340/686.6
2011/0046813 A1 * 2/2011 Castaneda ..... B66F 9/0755 701/2
2011/0166721 A1 * 7/2011 Castaneda ..... B62D 15/0265 701/2
2011/0286007 A1 * 11/2011 Pangrazio ..... G01B 11/00 356/614
2012/0078471 A1 * 3/2012 Siefring ..... B66F 9/0755 701/41
2012/0152653 A1 6/2012 Bowden
2012/0211301 A1 8/2012 Clark
2013/0153333 A1 6/2013 Richards
2013/0197760 A1 * 8/2013 Castaneda ..... B66F 9/07581 701/41
2013/0233645 A1 * 9/2013 Hao ..... B66F 17/006 182/19
2013/0313040 A1 11/2013 Cummings et al.
2014/0324310 A1 * 10/2014 Kobayashi ..... B62D 15/0285 701/70
2014/0332314 A1 11/2014 Carrillo et al.
2015/0008073 A1 1/2015 Cummings et al.
2015/0027808 A1 1/2015 Baillargeon et al.
2015/0144426 A1 * 5/2015 Hao ..... B66F 11/04 182/113
2015/0210115 A1 7/2015 David
2015/0217981 A1 * 8/2015 Baillargeon ..... B66F 11/044 182/2.8
2015/0368082 A1 * 12/2015 Davis ..... B66F 17/006 701/50
2016/0075543 A1 3/2016 Lombardo et al.
2016/0221812 A1 * 8/2016 Puszkiewicz ..... B66F 11/044
2016/0264131 A1 * 9/2016 Chan ..... B60W 30/025
2016/0332856 A1 11/2016 Steedley
2017/0008534 A1 * 1/2017 Nakatsuka ..... B60K 28/06
2017/0021764 A1 * 1/2017 Adams ..... B60Q 9/00
2017/0107090 A1 * 4/2017 Mondal ..... B66F 17/006
2017/0233232 A1 8/2017 Davis
2017/0241155 A1 * 8/2017 Johnson ..... B66F 11/046
2017/0255966 A1 * 9/2017 Khoury ..... G08G 1/0129
2017/0316696 A1 * 11/2017 Bartel ..... G08G 1/202
2018/0022358 A1 * 1/2018 Fung ..... G06K 9/00536
2018/0022405 A1 * 1/2018 Gecchelin ..... B62D 47/006

FOREIGN PATENT DOCUMENTS

CN 202030492 11/2011
CN 202379687 8/2012
CN 204281238 4/2015
FR 2 836 468 8/2003
FR 3 000 200 12/2012
GB 2481709 1/2012
GB 2495158 4/2013
JP 62-153098 7/1987
JP 63-142400 9/1988
JP 1-118987 8/1989
JP 4-65299 6/1992
JP 4-77600 7/1992
JP 5-124800 5/1993
JP 8-277099 10/1996
JP 9-40381 2/1997
JP 2003-221195 8/2003
JP 2007-43383 2/2007
JP 2011-63352 3/2011
JP 2013-52948 3/2013
JP 2013-545693 12/2013
WO WO 2009/037429 3/2009
WO WO 2011/015815 2/2011
WO WO 2012/001353 1/2012
WO WO 2012/088091 6/2012
WO WO 2014/206982 12/2014

OTHER PUBLICATIONS

Chinese Office Action dated Apr. 28, 2015 issued in Chinese Patent Application No. 201180053891.1 and English translation, 13 pp.
European Search Report dated May 22, 2014 issued in European Patent Application No. 11852006.3, 8 pp.
Japanese Office Action dated Apr. 23, 2014 issued in Japanese Patent Application No. 2013-544880 and English Translation, 6 pp.
International Search Report dated Apr. 24, 2012 issued in PCT International Patent Application No. PCT/US2011/066122, 4 pp.
International Preliminary Report on Patentability dated Jan. 9, 2013 issued in PCT International Patent Application No. PCT/US2011/066122 8 pp.
European Search Report dated Apr. 6, 2017 issued in European Patent Application No. 16198347.3, 9 pp.
U.S. Office Action dated Aug. 25, 2016 issued in U.S. Appl. No. 14/610,996, 32 pp.
Extended European Search Report dated Nov. 8, 2017 issued in European Patent Application No. 17163943.8, 11 pp.
U.S. Office Action dated Dec. 12, 2017 issued in U.S. Appl. No. 14/610,996, 16 pp.
U.S. Office Action dated Dec. 20, 2017 issued in U.S. Appl. No. 15/094,286, 25 pp.
U.S. Office Action dated Jun. 26, 2017 issued in U.S. Appl. No. 14/610,996, 17 pp.
Canadian Office Action dated Feb. 16, 2018 issued in Canadian Patent Application No. 2,961,995, 5 pp.
European Examination Report dated Oct. 18, 2018 issued in European Patent Application No. 16198347.3, 4 pp.

(56) References Cited

OTHER PUBLICATIONS

Chinese Office Action dated Aug. 2, 2018 issued in Chinese Patent Application No. 201710220836.6 and English translation, 19 pp.

* cited by examiner

WORK PLATFORM WITH PROTECTION AGAINST SUSTAINED INVOLUNTARY OPERATION

CROSS-REFERENCES TO RELATED APPLICATIONS

This application is a continuation-in-part (CIP) of U.S. patent application Ser. No. 13/885,720, filed May 16, 2013, pending, which is the U.S. national phase of PCT International Patent Application No. PCT/US2011/066122 filed Dec. 20, 2011, which claims the benefit of U.S. Provisional Patent Application No. 61/424,888, filed Dec. 20, 2010, and U.S. Provisional Patent Application No. 61/435,558, filed Jan. 24, 2011, the entire contents of each of which are hereby incorporated by reference in this application.

STATEMENT REGARDING FEDERALLY SPONSORED RESEARCH OR DEVELOPMENT (NOT APPLICABLE)

BACKGROUND OF THE INVENTION

The invention relates to work platforms and, more particularly, to a work platform including an obstruction sensing system to reduce the possibility of collision with an obstruction or structure.

Lift vehicles including aerial work platforms, telehandlers such as rough terrain telescoping fork trucks with work platform attachments, and truck mounted aerial lifts are known and typically include an extendible flexible configuration boom, which may be positioned at different angles relative to the ground, and a work platform at an end of the boom. On or adjacent the platform, there is typically provided a control console including various control elements that may be manipulated by the operator to control such functions as boom angle, boom extension, rotation of the boom and/or platform on a vertical axis, engine or other type of power source, and where the lift vehicle is of the self-propelled type, there are also provided steering, drive speed and direction and braking controls.

A safety hazard can occur in a lift vehicle including a work platform when an operator is positioned between the platform and a structure that may be located overhead or behind the operator, among other places. Collision avoidance is also desirable with objects around the platform for example glass surfaces, aircraft structures, and other more fragile or delicate structures.

BRIEF SUMMARY OF THE INVENTION

A camera sensor or the like may be mounted to the aerial work platform to observe the platform, the area around the platform, and the operator. The system processes data from the sensor to determine whether the operator is present and if the operator is in a proper operating position and also to determine the proximity of objects above, behind and to the sides of and below the platform. Based on data from the sensor, a control module permits, modifies or prevents operation and/or manipulation of the platform.

In an exemplary embodiment, a work platform is combined with a system for detecting obstacles. The work platform includes a control panel with operating components that control a position of the platform. The combined work platform and system include a sensor mounted in a vicinity of the platform that monitors at least one of an operator area, the platform, and an area around the platform, and a processor receiving a signal from the sensor that processes the signal to determine at least one of a position of an operator on the platform and a proximity of objects in the area around the platform. A control module communicating with the processor and the operating components modifies control signals from the control panel based on communication with the processor.

The processor may determine that the operator is not present or is not in a proper operating position, and the control module may be programmed to prevent operation of the platform that would cause motion of the platform. An override switch may be connected with the control module, where the control module may be programmed to permit operation of the platform at very slow or creep speed based on activation of the override switch. The processor may determine that the operator is leaning over the control panel, and the control module may be programmed to stop active functions and prevent further operation of the platform that would cause motion of the platform. The processor may determine that the operator is leaning over the control panel for a predetermined time, and the control module may be programmed to reverse a last operating function of the platform. The processor may determine that the operator is present and in a proper operating position and that there are no objects in the area around the platform, and the control module may be programmed to permit normal operation of the platform.

In one embodiment, the sensor may be programmed to distinguish the area around the platform between a warning zone and a danger zone, where the danger zone is closer to the platform than the warning zone. The processor may determine that an object is present in the warning zone, and the control module may be programmed to permit operation of the platform at creep speed based on the determination that the object is present in the warning zone. The processor may determine that an object is present in the danger zone, and the control module may be programmed to prevent operation of the platform based on the determination that the object is present in the danger zone. The sensor may be programmed to adjust a depth of at least one of the warning zone and the danger zone based on operating characteristics of the platform. Exemplary operating characteristics may include a number of operators on the platform, a direction in which the platform is traveling, and a speed of the platform. The control module may detect a speed of the platform, wherein the processor is programmed to process signals from the sensor relating to the platform speed toward one of the objects in the area of the platform. In this context, the control module may be programmed to slow active functions at a rate relative to the speed at which the platform is approaching the one of the objects in the area of the platform. The control module may be programmed to reduce a commanded operation speed based on a proximity to one of the objects in the area of the platform.

The sensor may include multiple sensing elements secured in the vicinity of the platform. In one arrangement, the platform may include a platform railing, where the sensor is mounted on the platform railing. The sensor may be one of an optical sensor, a radar sensor, and an acoustic sensor. The sensor may be attached to a manipulation device such as a pan and/or tilt mechanism or a mirror that displaces or rotates the sensor field of view.

In another exemplary embodiment, an aerial work platform includes a control panel including operator controls for manipulating the platform, a control module communicating with the operator controls and controlling manipulation of the platform based on signals from the control panel, and an obstruction sensing system. The obstruction sensing system includes a sensor mounted in a vicinity of the platform that monitors an operator area, the platform, and an area around the platform, and a processor receiving a signal from the sensor that processes the signal to determine a position of an operator on the platform and a proximity of objects in the area around the platform. The control module is in communication with the processor and is programmed to modify control signals from the operator controls based on communication with the processor.

In yet another exemplary embodiment, a method of controlling an aerial work platform includes the steps of (a) monitoring with a sensor mounted in a vicinity of the platform an operator area, the platform, and an area around the platform; (b) detecting with a processor receiving a signal from the sensor a position of an operator on the platform and a proximity of objects in the area around the platform; and (c) a control module modifying control signals from an operator control panel based on communication with the processor and based on the detection in step (b). Step (c) may be practiced by preventing operation of the platform when an operator is not present or is not in a proper operating position. Step (b) may be practiced to determine whether the operator is leaning over a control panel for a predetermined period of time, and step (c) may be practiced by preventing operation of the platform during the predetermined period of time and after the predetermined period of time, reversing a last operating function of the platform. Step (c) may be practiced by permitting operation of the platform at creep speed when an object is detected in the warning zone, and by preventing operation of the platform when an object is detected in the danger zone.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
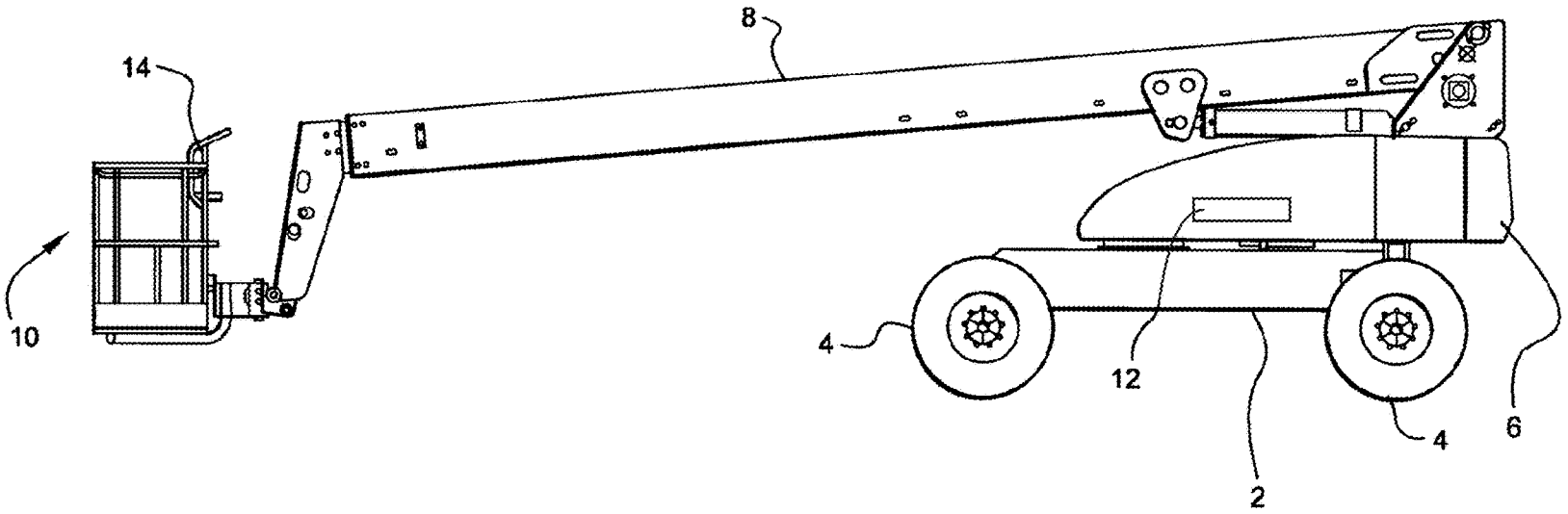
FIG. 1 shows an exemplary aerial lift vehicle including a work platform.

FIG. 1 illustrates an exemplary typical aerial lift vehicle including a vehicle chassis 2 supported on vehicle wheels 4. Although the vehicle shown includes a telescoping boom, the invention is equally applicable to other vehicles including, for example, articulated booms without telescoping or extendable booms. A turntable and counterweight 6 are secured for rotation on the chassis 2, and an extendible (flexible arrangement) boom assembly is pivotably attached at one end to the turntable 6. An aerial work platform 10 is attached at an opposite end of the extendible boom 8. The illustrated lift vehicle is of the self-propelled type and thus also includes a driving/control system (illustrated schematically in FIG. 1 at 12) and a control console 14 on the platform 10 with various control elements that may be manipulated by the operator to control such functions as boom angle, boom extension, rotation of the boom and/or platform on a vertical axis, and engine, steering, drive speed and direction and braking controls, etc.

Figure 2:
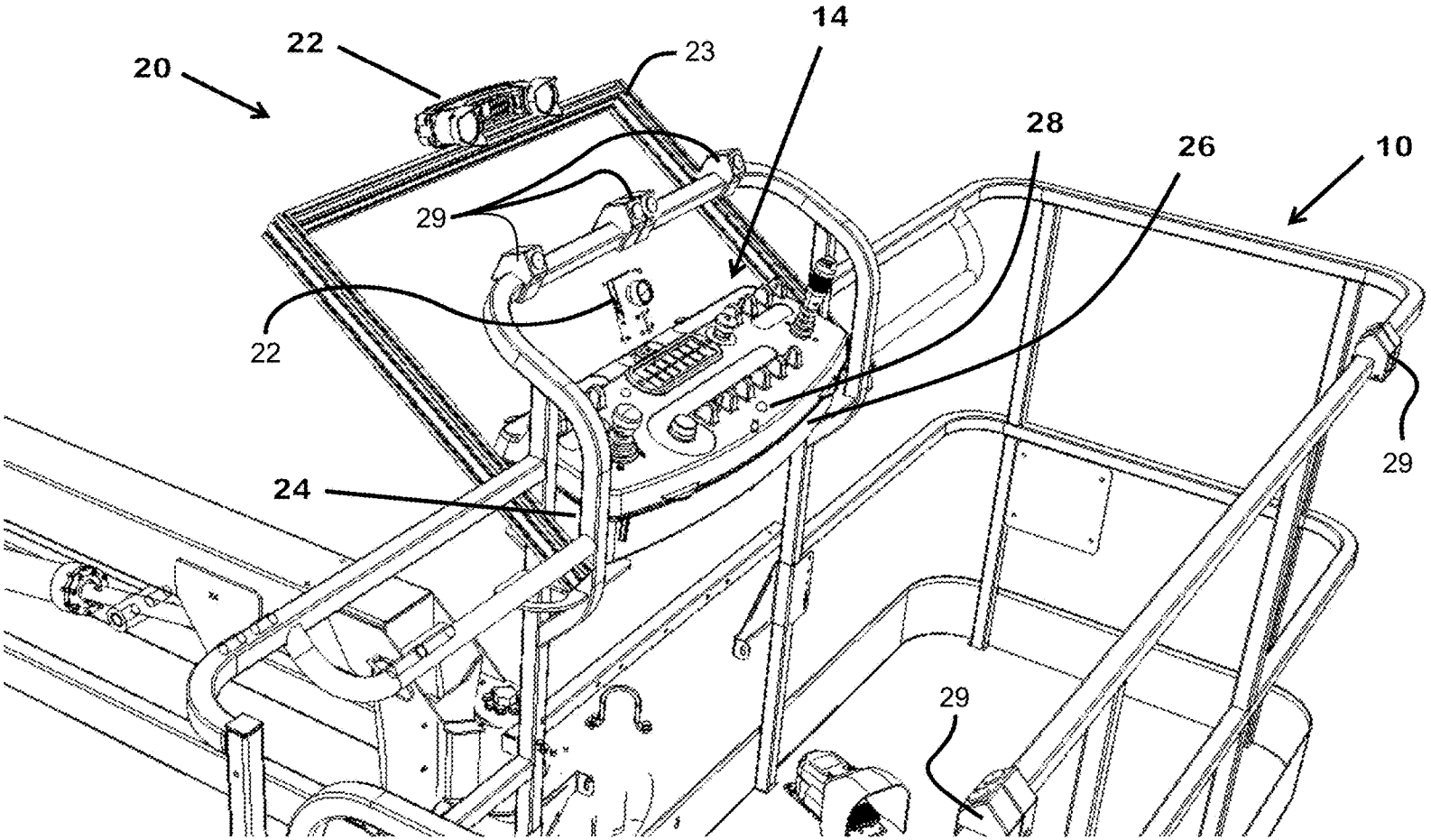
FIG. 2 is a perspective view of the work platform and obstruction sensing system according to preferred embodiments of the invention.

FIG. 2 shows the combined work platform 10 and system 20 for detecting obstructions such as obstacles around the platform including overhead obstacles. A sensor 22 is mounted in a vicinity of the platform and monitors at least one of an operator area, the platform, and an area around the platform. The sensor 22 may be a stereo camera sensor that provides a data stream consisting of pixel data (RGB value and range) to a computer or processor 24 mounted on the platform 10. An exemplary stereo camera sensor is Multi-Sense S21 available from Carnegie Robotics. Those of ordinary skill in the art will appreciate alternative sensors that may be suitable, and the invention is not meant to be limited to a specific sensor type.

The obstruction sensing system 20 may include multiple sensors 22 that are cooperable together and mounted in various areas in the vicinity of the platform 10. In an exemplary construction, the platform 10 includes a platform railing, and the sensor 22 is mounted on the platform railing. Mounting on the platform provides for a static view of the platform through the full range of boom articulation. Sensors may alternatively or additionally be mounted to boom structure to allow for a larger field of view of the platform and/or mounted to platform support structure other than the railing. For example, as shown, the sensor 22 may be mounted on a dedicated bracket 23 secured to the platform, or the sensor 22 may be secured adjacent the control panel 14.

Figure 2A:
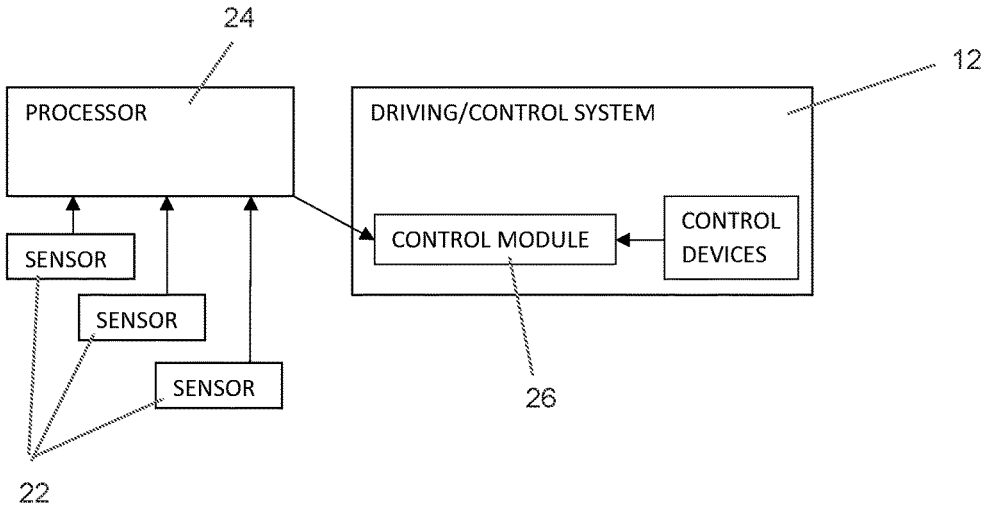
FIG. 2A is a schematic diagram of the system.
Figure 3:
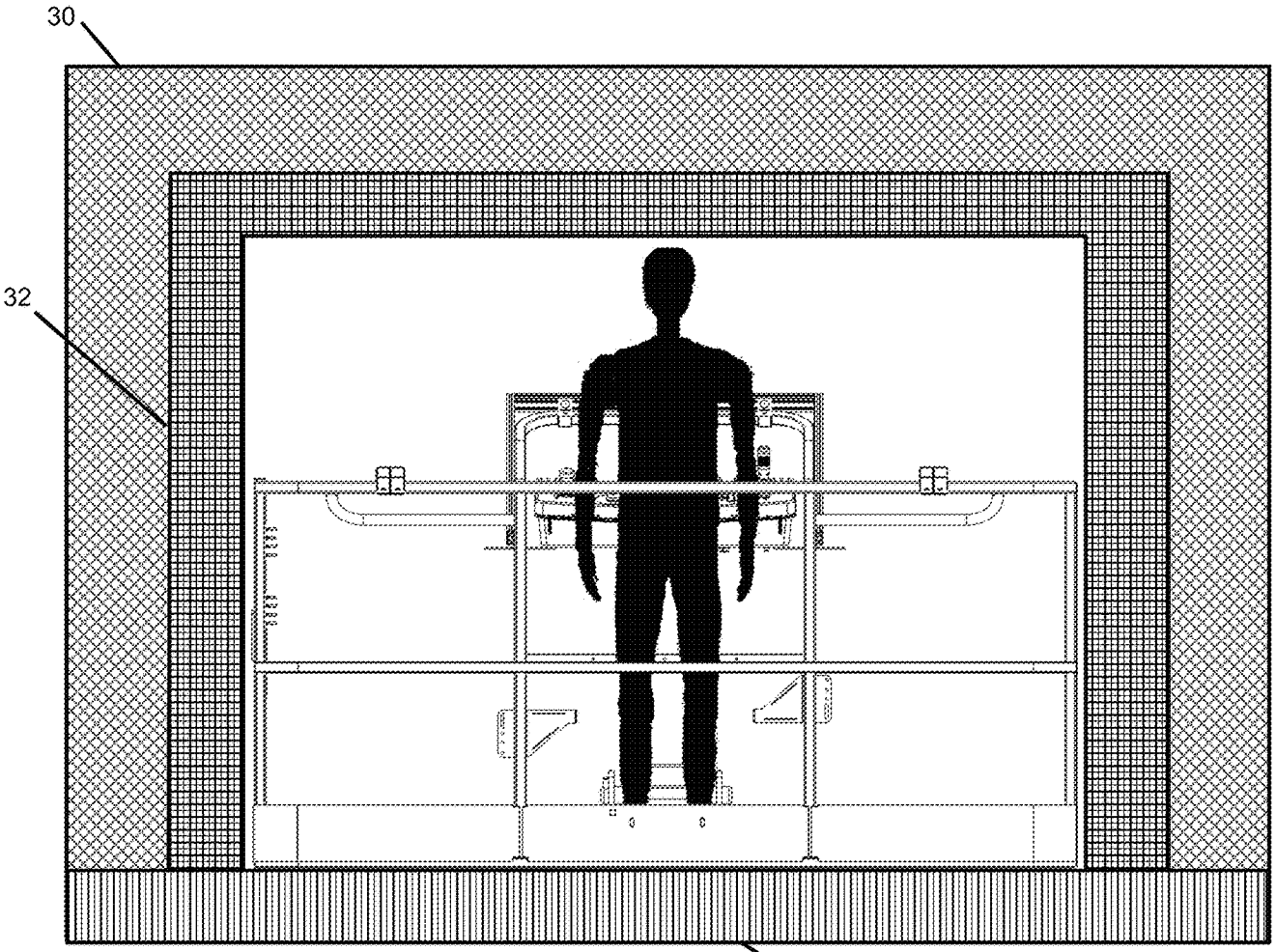
FIGS. 3-16 show the platform and the non-adaptive and adaptive areas monitored by the sensor.
Figure 4:
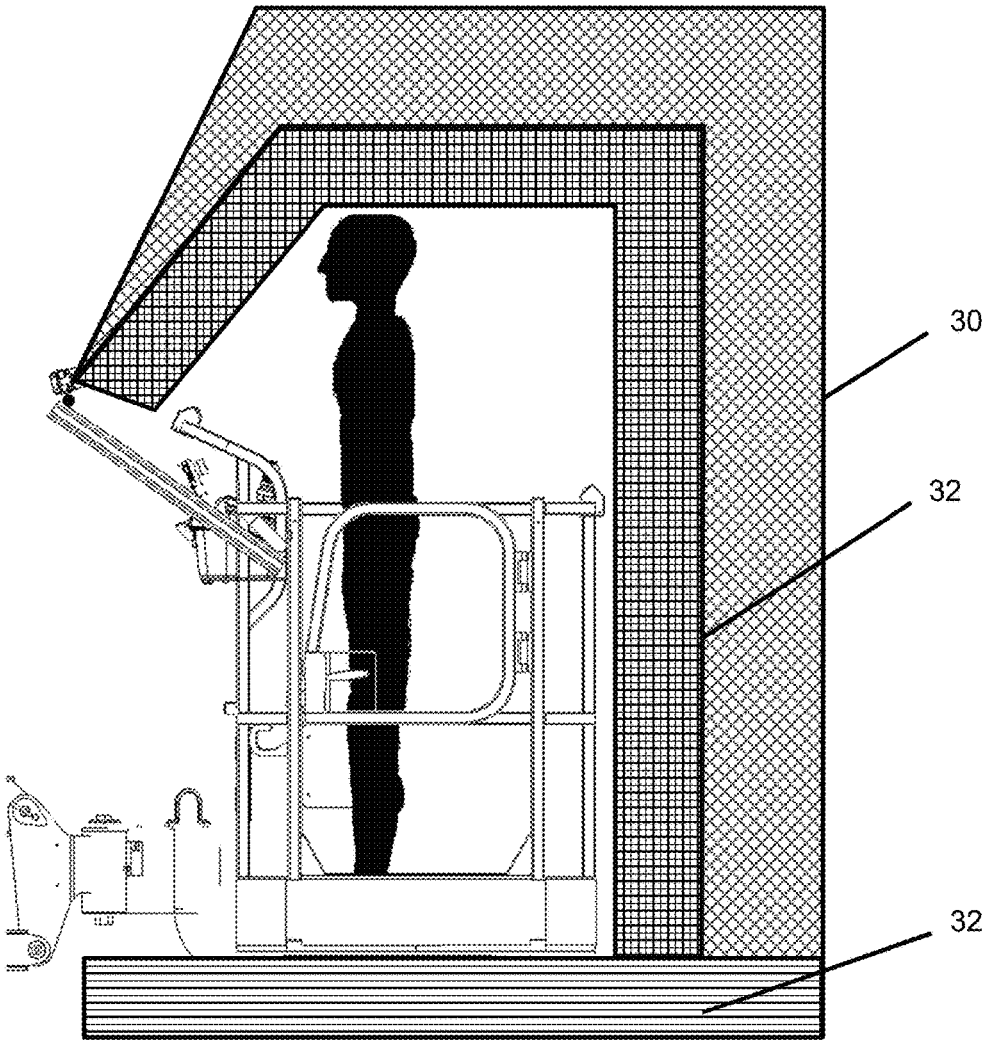

With reference to FIGS. 2 and 2A, the computer or processor 24 processes the pixel range data to determine at least one of a position of an operator on the platform 10 and a proximity of objects in the area around the platform 10. A control module 26 in the control panel 14 forms part of the driving/control system 12 and communicates with the processor 24 to control operation of the platform based on a signal from the processor 24. In some arrangements, the control module 26 communicates with the driving/control system 12, which controls overall operation of the machine. In this arrangement, the control module 26 may gather input from control devices such as joysticks, switches, etc. and communicate operator commands to the driving/control system 12.

In some embodiments, the processor 24 determines whether the operator is not present or is not in a proper operating position, and if so, the control module 26 is programmed to prevent operation of the platform 10. That is, if the operator is not detected, the computer 24 sends a data message to the control module 26 that prevents motion or operation, or stops all active functions of the work platform 10. The system may also include an override button 28, where the platform 10 may be operated at creep speed if the override button 28 is activated.

The processor 24 may determine that the operator is leaning over the control panel 14, in which case, the control module 26 is programmed to prevent operation of the platform 10. If the processor 24 determines that the operator is leaning over the control panel for a predetermined time, the control module 26 is programmed to reverse a last operating function of the platform. In this instance, the system may also sound an alarm and turn on a warning beacon.

Indicator lamps 29 may be secured to the platform railing and around the control panel to communicate system status to the operator. Exemplary locations for the indicator lamps 29 are shown in FIG. 2. The control module 26 may cause the indicator lamps 29 to illuminate when the control module 26 is in any way affecting machine control. (e.g., when the sensors 22 indicate that the machine is getting too close to an obstacle).

FIGS. 3-8 show exemplary sensing areas for detecting the proximity of objects above, behind, below and to the sides of the platform 10. The sensor 22 is programmed to distinguish the area around the platform between a warning zone (Zone A) 30 and a danger zone (Zones B and C) 32, where the danger zone 32 is closer to the platform 10 than the warning zone 30 as shown. If the processor 24 determines that an object is present in the warning zone, the control module 26 is programmed to permit operation of the platform 10 at creep speed. If the processor 24 determines that an object is present in the danger zone 32, the control module 26 is programmed to prevent operation of the platform 10 (i.e., stop all active functions and/or prevent the start or continuation of any operation). At any time when the control module 26 prevents operation of the platform 10 that would cause motion of the platform 10, activation of the override switch 28 will permit operation of the platform 10 at creep speed. If the processor 24 determines that the operator is present and in a proper operating position and that there are no objects in the area around the platform 10 (i.e., in proximity defined by proscribed zones), the control module 26 permits normal, unrestricted operation of the platform 10. If no operator is present, operation of the platform that would cause motion of the platform is prevented unless overridden with the override switch 28.

Because the processor 24 is interpreting shape and distance from an obstacle in real time, the processor 24 can be programmed to estimate direction and speed of movement of the platform in relation to recognized obstacles. The processor 24 can be programmed to take action even when those obstacles are outside of the warning zone 30. For example, the processor 24 can be programmed to signal the driving/control system 12 to slow down machine functions such as drive when the processor 24 recognizes that the operator is driving the machine at full speed in the direction of potential obstacle. As another example, the boom functions (or drive function) can be slowed down more aggressively if the processor determines that the machine is moving fast toward a collision point.

Figure 5:
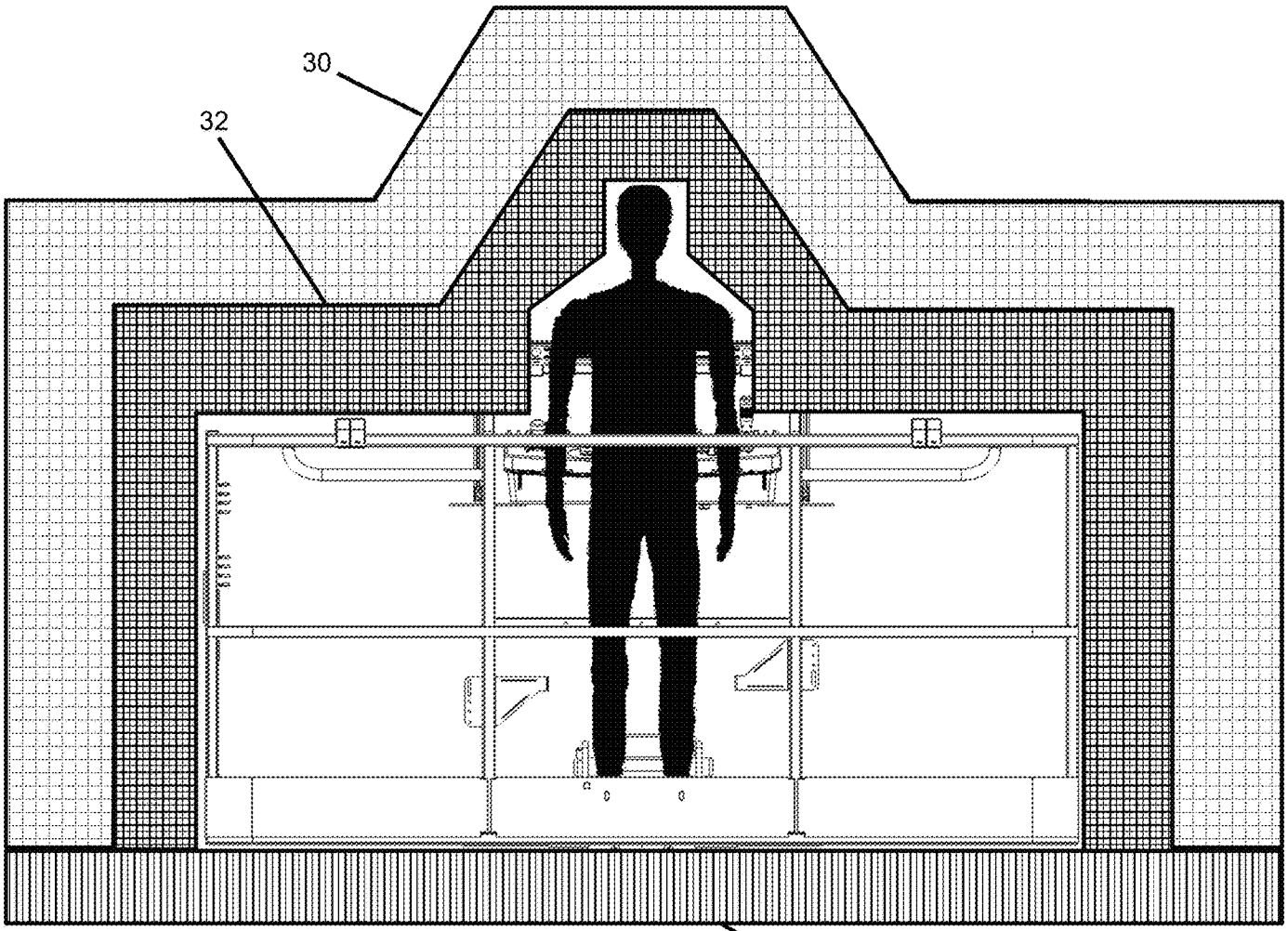
Figure 6:
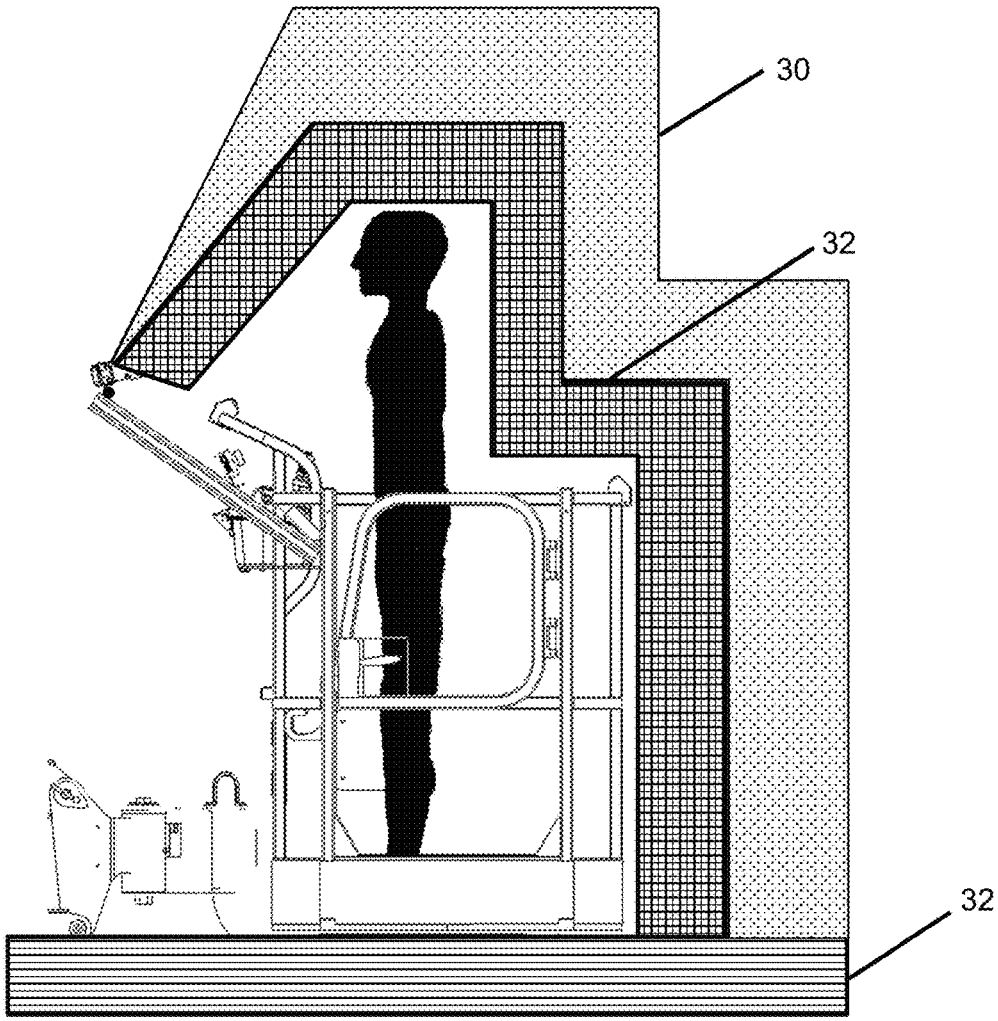
Figure 7:
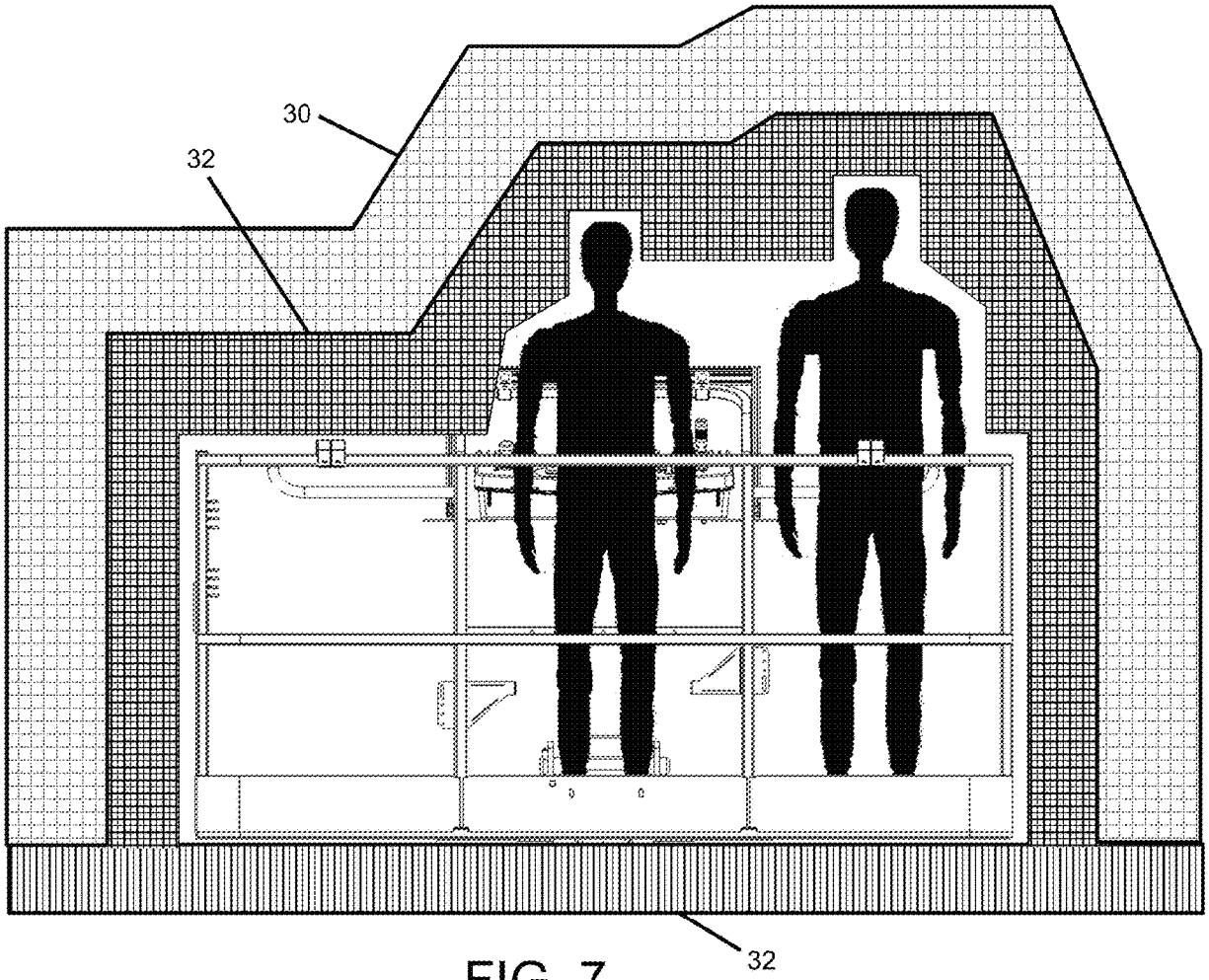
Figure 8:
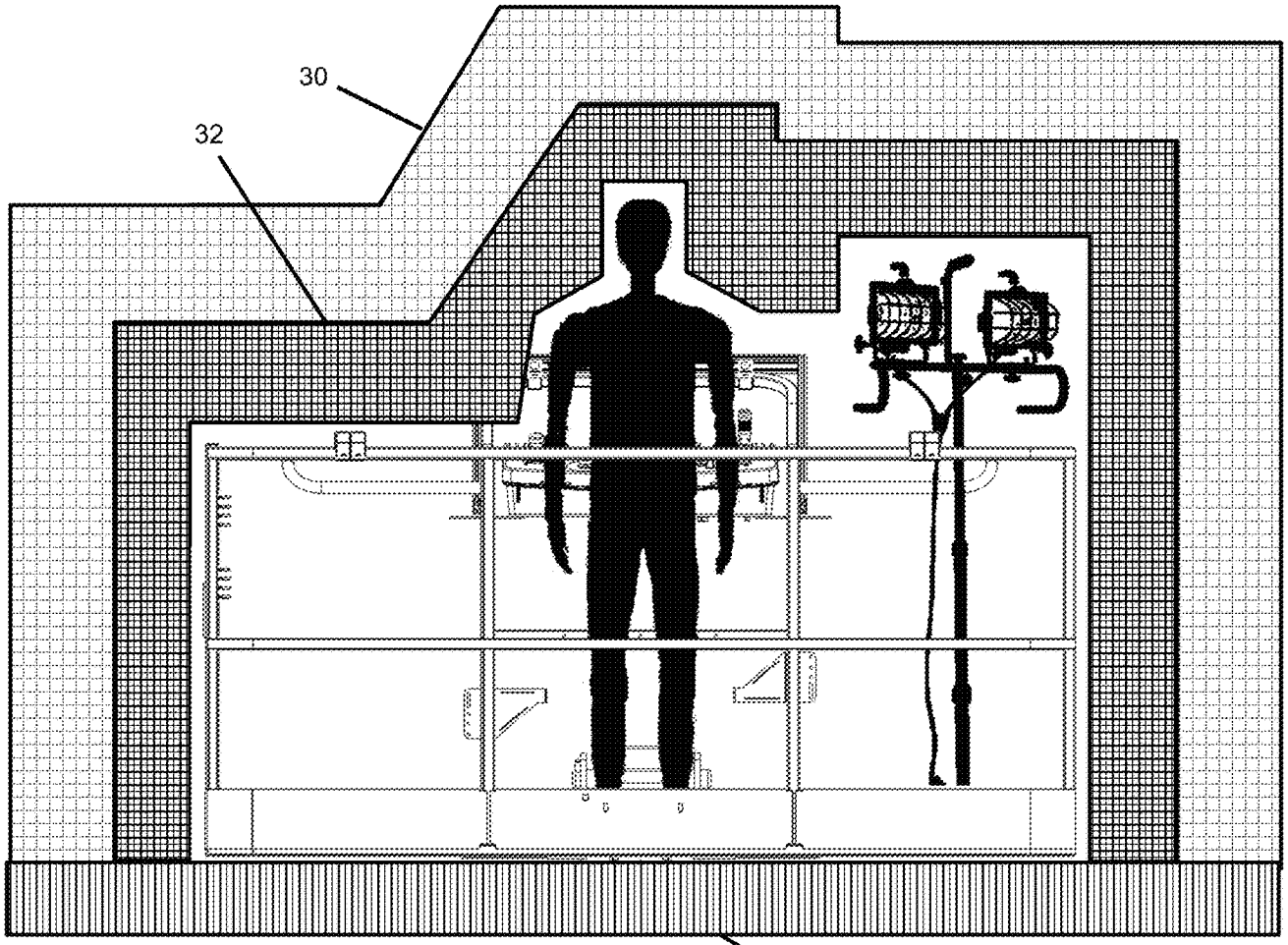

With reference to FIGS. 5-8, the warning zone 30 and the danger zone 32 may be configured as adaptive zones, where based on the picture of the surrounding environment, the control module 26 can adjust the size and shape of the respective zones 30, 32. Adaptive zones are calculated by the control module based on sensor system/controller ability to recognize, among other things, the number of people in the platform, or the combination of people and materials (tools, equipment) present in the platform. FIGS. 7 and 8 illustrate results of the controller module calculation. In FIGS. 5 and 6, the zones 30, 32 are adapted according to a specific operator. In FIG. 7, the zones 30, 32 are adapted according to the presence of two operators, and in FIG. 8, the zones are adapted according to an operator and equipment on the platform.

Various methods may be used for reducing the platform speed based on detected object distance. In a "speed limiting" method, a limit for the maximum commandable speed is set based on the distance to the detected object (see, e.g., FIGS. 5-13). In a "speed reducing" method, the operator input is scaled down based on the distance to the detected obstacle (see, e.g., FIGS. 14-16). These two methods may result in different machine behavior.

Figure 9:
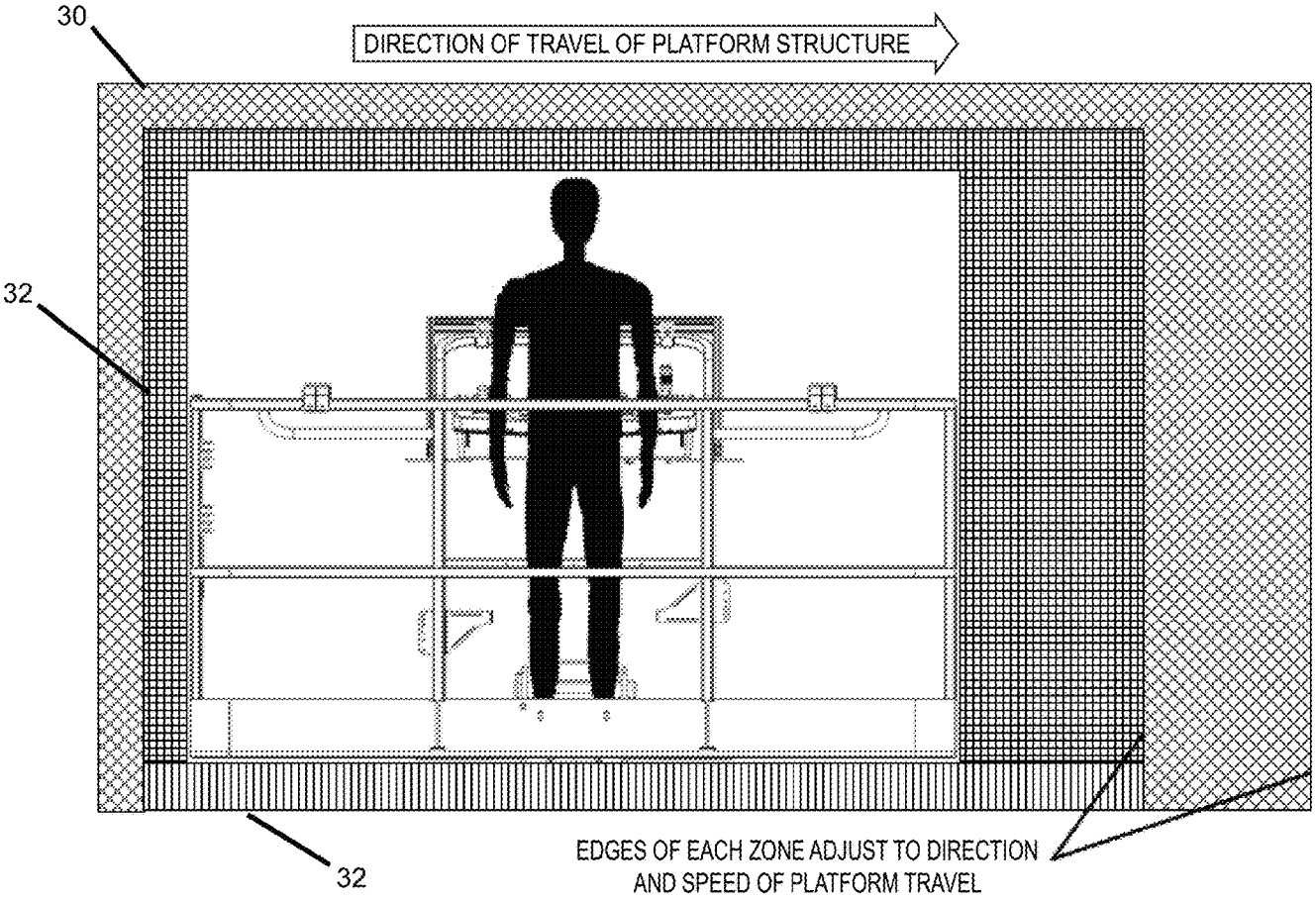
Figure 10:
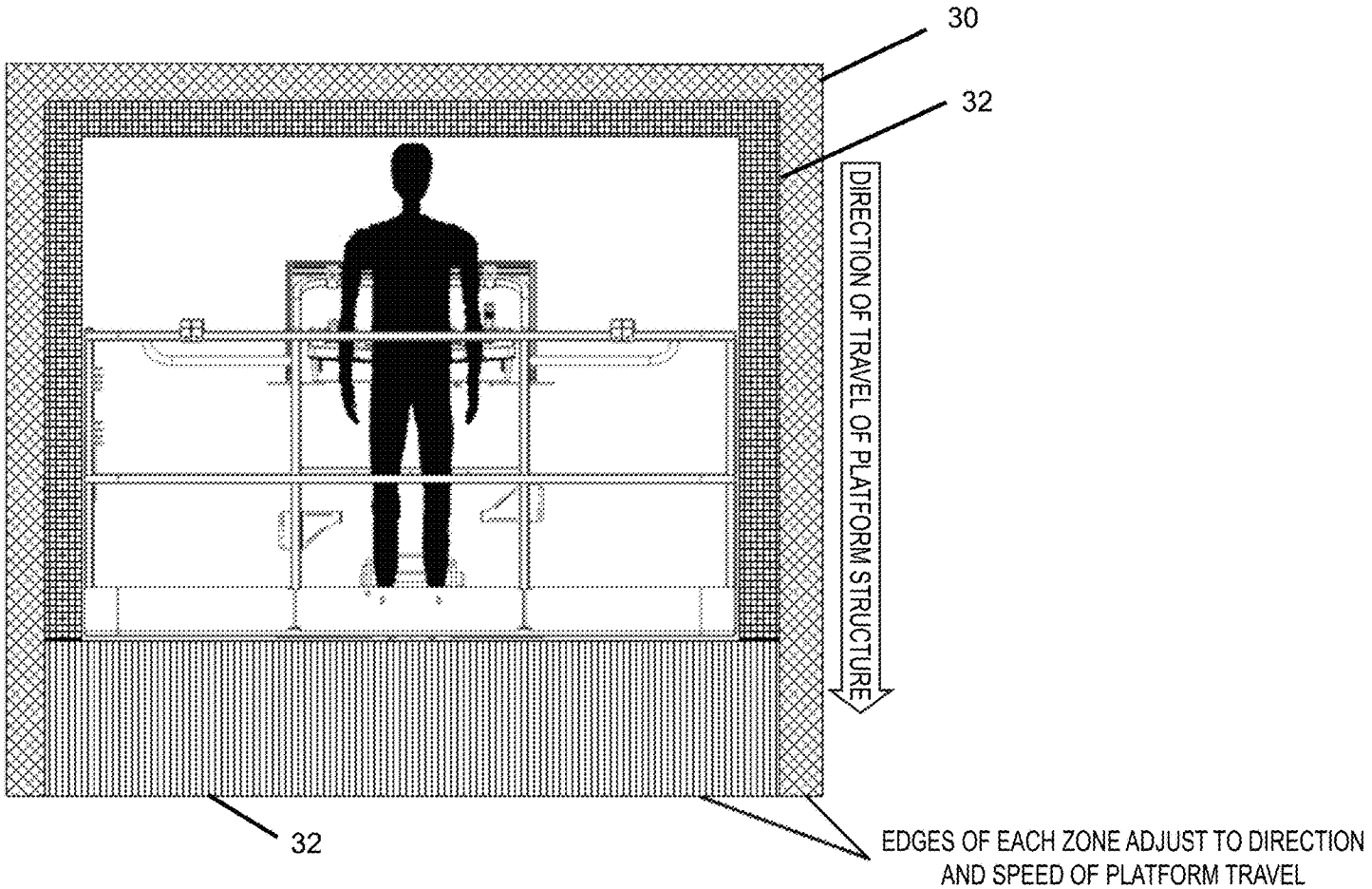
Figures 11, 12, 13:
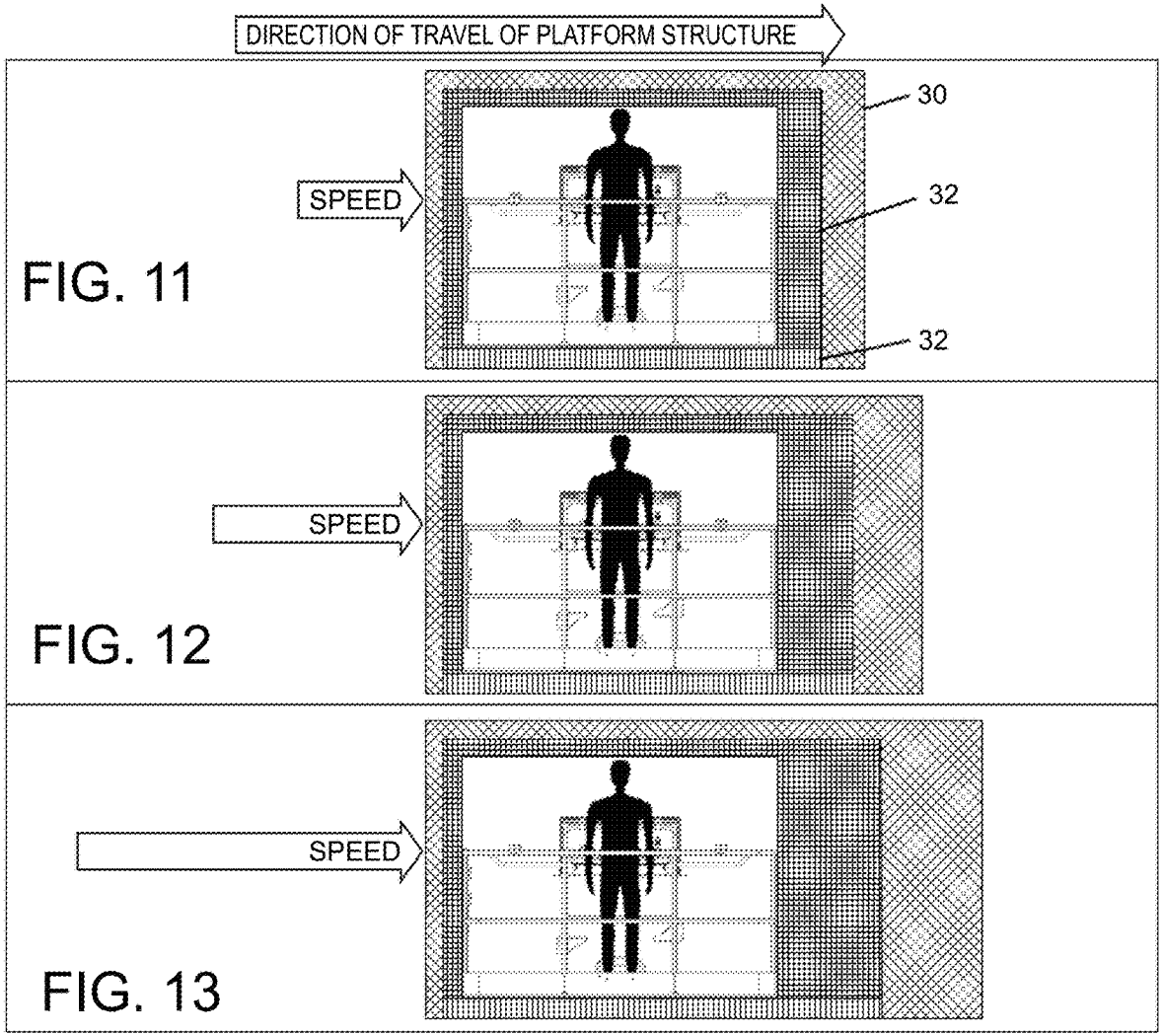

The zones may be adapted to speed and direction of machine movement. Zones can be adjusted to become deeper if it is determined that the machine is moving faster than a threshold speed, or the zones can be "deeper" in the main direction of travel when activating the swing or other direction function. The control module may adjust the sensors to penetrate deeper into the direction of the side of platform. FIGS. 9-13 show variations in a depth of the warning zone and/or the danger zone based on platform speed and direction. More specifically, FIG. 9 shows the platform traveling to the right with each of the right side warning zone and danger zone having an increased depth. FIG. 10 shows the platform descending with the warning and/or danger zones having an increased depth in the direction of platform movement. The system may be programmed to adjust the depth of the zones based on the speed of the platform. FIGS. 11-13 show a proportionally increased depth with increasing platform speed.

Figure 14:
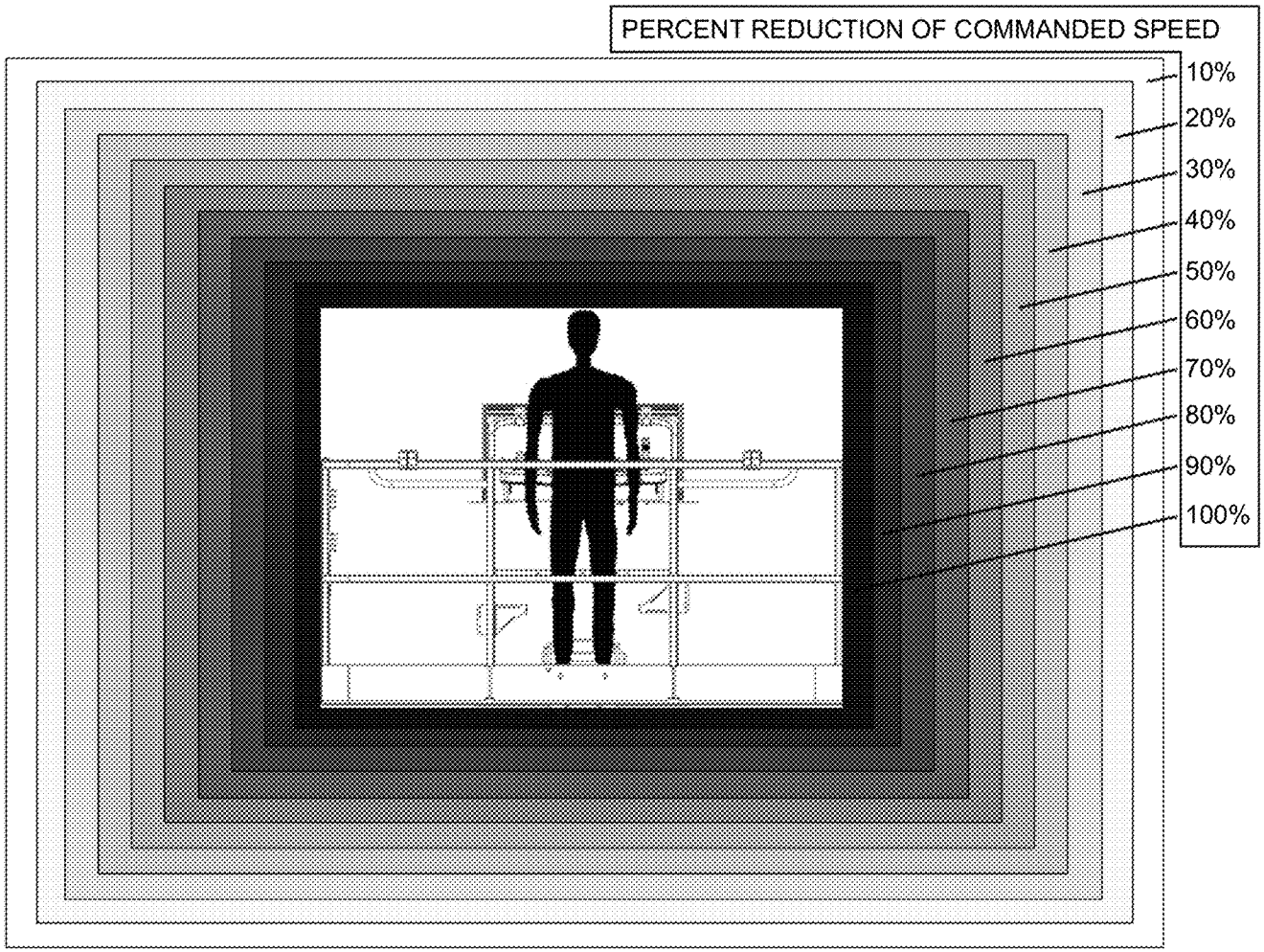
Figure 15:
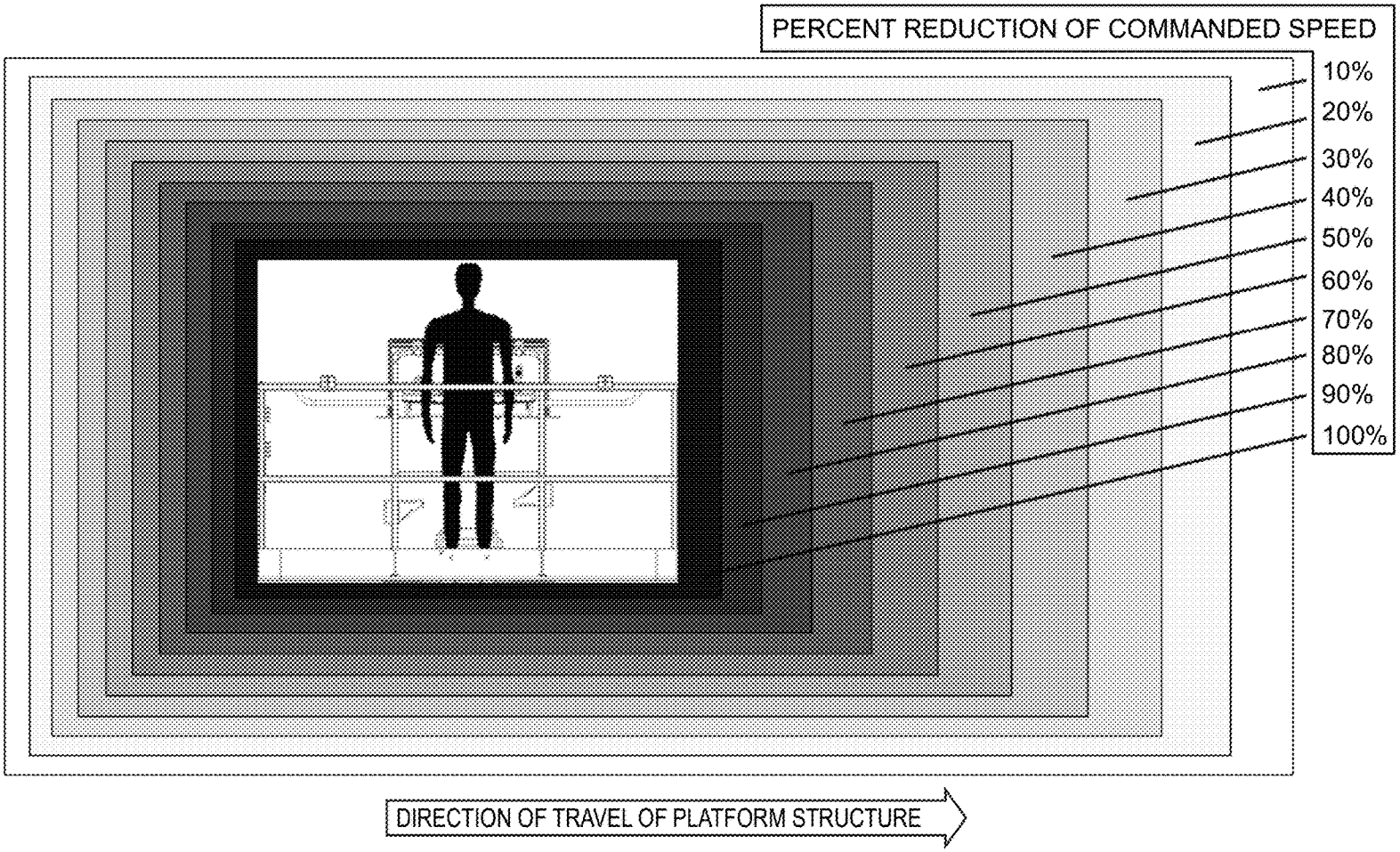
Figure 16:
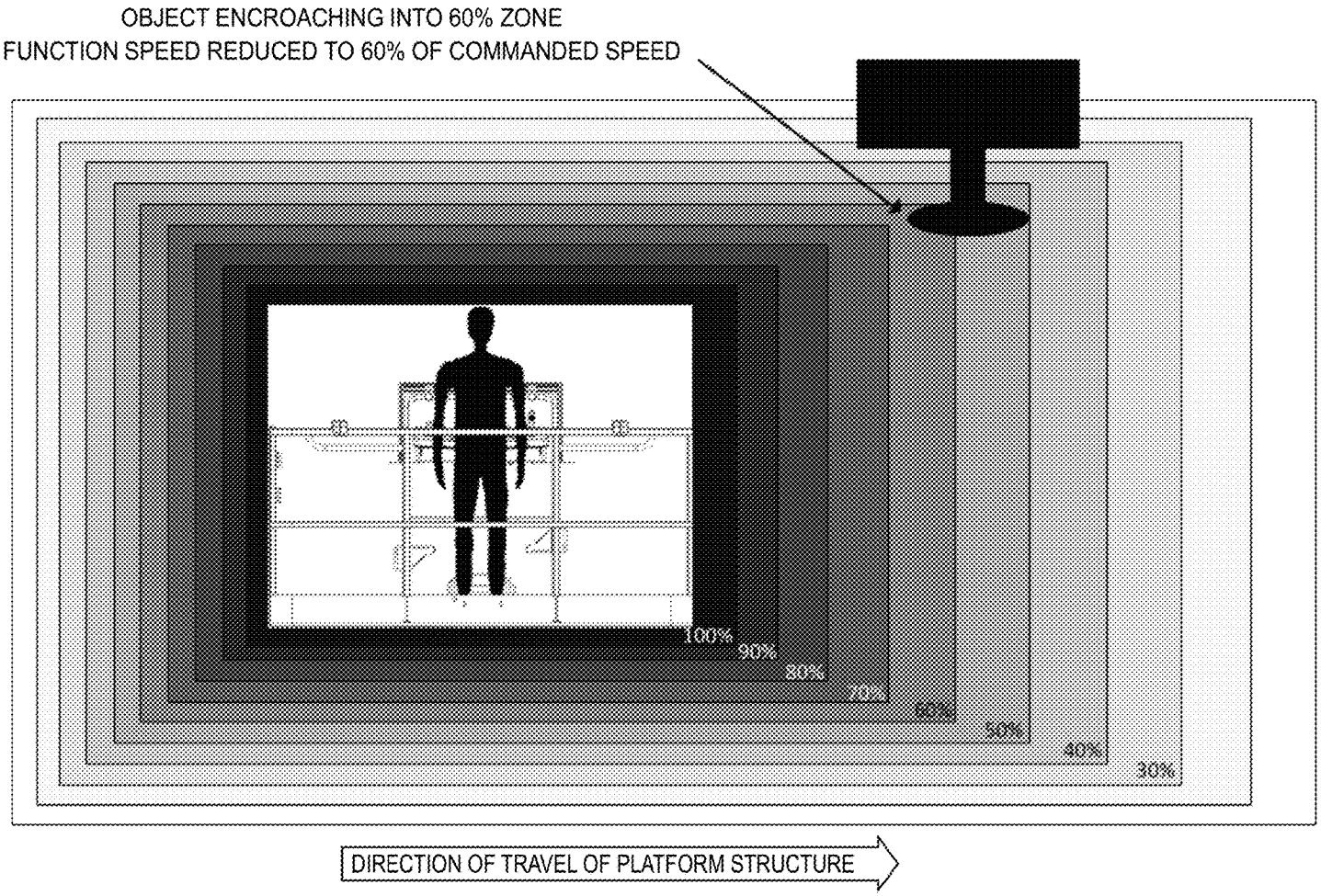
Figure 17:
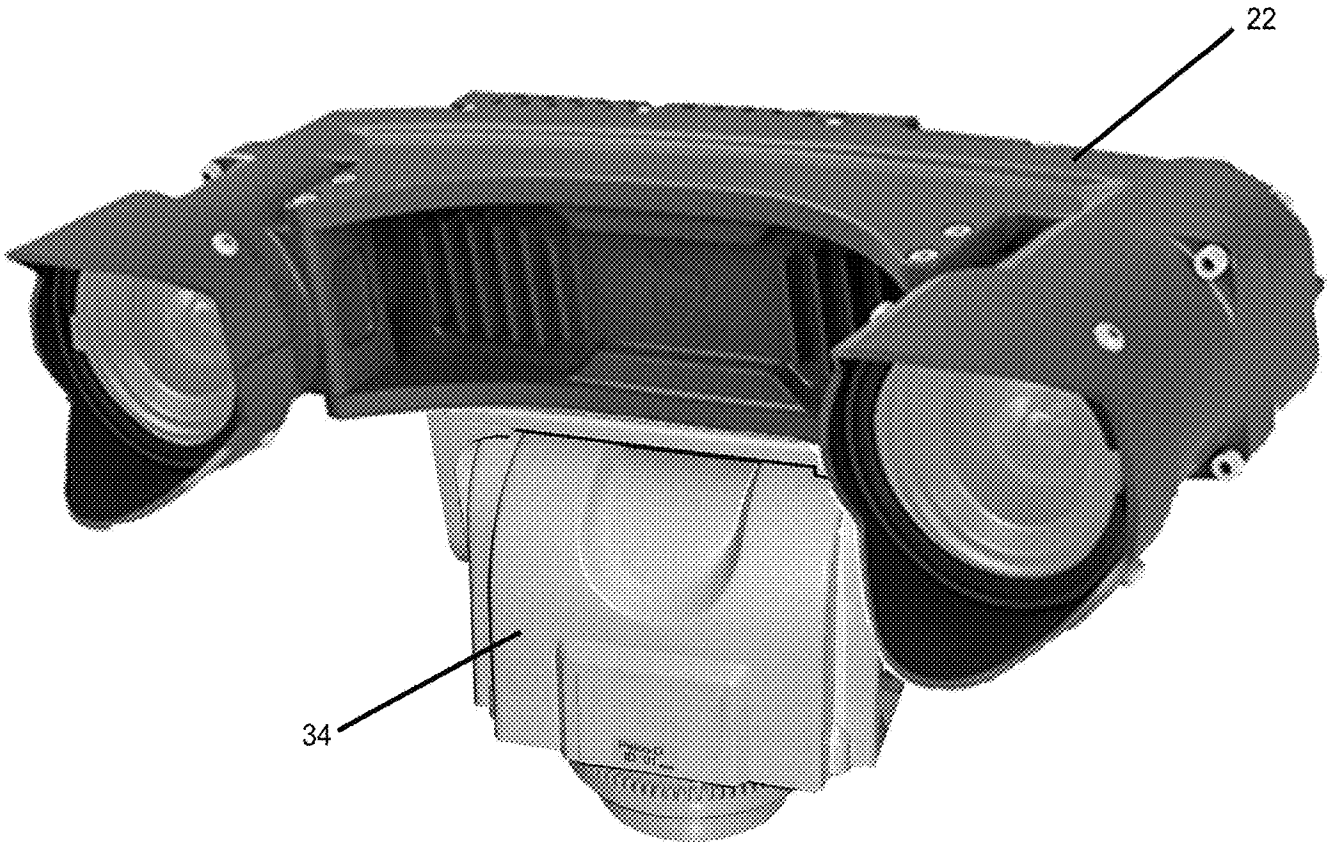
FIGS. 17-21 show an exemplary pan/tilt mechanism and functionality for the sensor unit.
Figure 18:
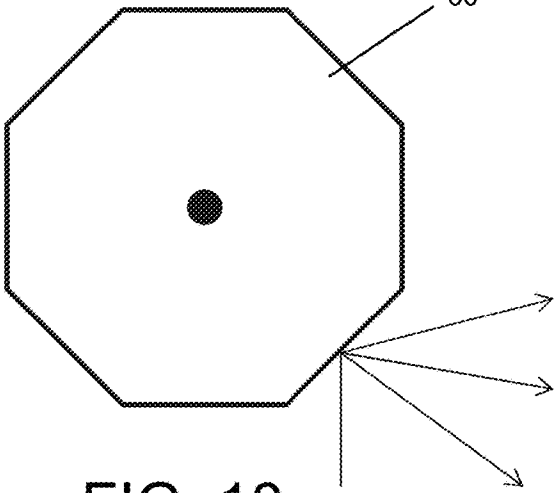
Figure 19:
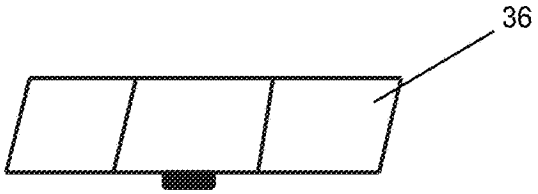
Figure 20:
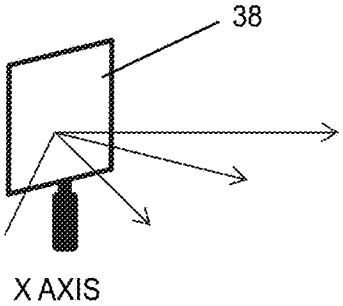
Figure 21:
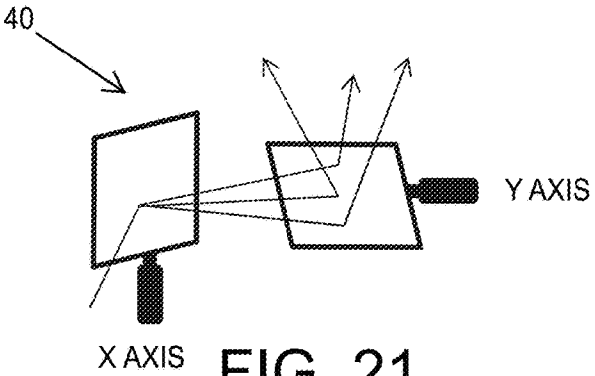

In a related context, the adaptive zones may incorporate proportional speed reduction zones as shown in FIGS. 14-16. In FIG. 14, the percent of commanded speed is reduced according to the proximity of the potential obstacle to the platform. The speed reduction zones are shown in discrete steps but may alternatively be continuous. In FIG. 15, the proportional speed reduction zones are combined with the zones adapted for speed and direction. In FIG. 15, the platform is traveling to the right, and the depth of the zones is modified accordingly. In FIG. 16, an object is detected in the 60% zone with the platform traveling to the right. The function speed is reduced to 60% of the commanded speed.

Communication between the sensor 22 and the processor 24 may be via digital packets (CANbus) or discrete signaling (digital or analog output). Other forms of digital communication may be used, allowing the sensor to provide information needed to evaluate environmental awareness. Examples include, without limitation, Ethernet, I2C, RS232/485, digital pulse width modulation (PWM), etc. The control module 26 interprets the data to determine if and how the machine should react to the sensor data. The processor 24 based on signals from the sensors 22 can determine if they need to be cleaned via a built-in test (BIT). The sensing elements 22 can be based on optical, radar or acoustic (ultrasonic) sensing. The sensing elements 22 can be a single device or multiple devices with the same or complementary technologies. This provides redundancy and tolerance to a range of environmental conditions, contamination on the sensors, and objects to be detected. Sensors may be passive (stereo camera, single camera) or active (light detection and ranging (LiDAR), laser detection and ranging (LADAR), 3D vision sensor), radar or acoustic (ultrasonic). Any suitable type of sensor(s) may be used, and the invention is not meant to be limited to the described exemplary embodiments. Alternative sensor arrangements that achieve the same functionality are also contemplated including, for example, sensors that react to an emitter (via electromagnetic waves or other signals), reflective tape (on the machine and/or incorporated into the operator's protective gear), etc.

With reference to FIGS. 17-21, the sensor 22 (camera, LiDAR, RADAR, etc.) can be manipulated either by mechanical rotation (pan/tilt) of the entire sensor using a suitable pan/tilt mechanism 34 (an exemplary pan/tilt mechanism is the Multisense S21 available from Carnegie Robotics), or by mechanical displacement/rotation of the field of view via a polygon reflector 36, single reflector 38, pair of reflectors 40 (optical mirror(s) for camera and LiDAR, metal plate(s) for radar and acoustic), etc. The manipulation device can be controlled either by the processor 24, control module 26, sensor 22, or be self-contained in the manipulation device. Manipulating a sensor or sensor field of view allows each sensor to cover more of the surrounding area around the platform and/or boom structure.

The platform and obstruction sensing system endeavor to avoid collisions between the moving platform and obstacles in the vicinity of the platform. The proactive system according to preferred embodiments is advantageous as compared to reactive systems that make adjustments after an obstacle has made contact with the operator and/or platform structure.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A combination of an aerial work platform secured on a vehicle chassis and a system for detecting proximate obstacles, the combination comprising:

the work platform including a control panel with operating components configured to control a position of the platform relative to the vehicle chassis;

a sensor mounted in a vicinity of the platform, the sensor configured to monitor at least one of an operator area, the platform, and an area around the platform;

a processor configured to receive a signal from the sensor, the processor configured to process the signal to determine at least one of a position of an operator on the platform and a proximity of objects in the area around the platform; and a control module configured to communicate with the processor and the operating components and configured to modify control signals from the control panel based on communication with the processor, wherein the sensor is programmed to distinguish the area around the platform between a warning zone and a danger zone, the danger zone being closer to the platform than the warning zone, wherein the processor is configured to determine that a warning zone object is present in the warning zone, and the control module is programmed to permit operation of the platform at creep speed based on the determination that the warning zone object is present in the warning zone, wherein the sensor is programmed to adaptively adjust a depth of at least one of the warning zone and the danger zone based on operating characteristics of the platform, wherein the processor is configured to determine that the operator is not present or is not in an operating position, and the control module is programmed to prevent operation of the platform indicated by the operating components that would cause motion of the platform.

2. The combination according to claim 1, wherein the processor is configured to determine that the operator is leaning over the control panel, and the control module is programmed to stop active functions and prevent further operation of the platform that would cause motion of the platform.

3. The combination according to claim 2, wherein the processor is configured to determine that the operator is leaning over the control panel for a predetermined time, and the control module is programmed to reverse a last operating function of the platform.

4. The combination according to claim 1, wherein the processor is configured to determine that a danger zone object is present in the danger zone, and the control module is programmed to stop active functions and prevent further operation of the platform that would cause motion of the platform based on the determination that the danger zone object is present in the danger zone.

5. The combination according to claim 4, further comprising an override switch connected with the control module, wherein the control module is programmed to permit operation of the platform at creep speed based on activation of the override switch.

6. The combination according to claim 1, wherein the operating characteristics comprise a number of operators on the platform, a direction in which the platform is traveling, and a speed of the platform.

7. The combination according to claim 1, wherein the control module is programmed to reduce a commanded operation speed based on a proximity to one of the objects in the area around the platform.

8. The combination according to claim 1, wherein the sensor comprises multiple sensing elements secured in the vicinity of the platform.

9. The combination according to claim 1, wherein the platform comprises a platform railing, and wherein the sensor is mounted on the platform railing.

10. The combination according to claim 1, wherein the sensor comprises one of an optical sensor, a radar sensor, and an acoustic sensor.

11. The combination according to claim 1, further comprising a manipulation device to which the sensor is attached.

12. The combination according to claim 11, wherein the manipulation device comprises at least one of a pan and a tilt mechanism.

13. The combination according to claim 11, wherein the manipulation device comprises a mirror that is configured to displace or rotate a field of view of the sensor.

14. A combination of an aerial work platform secured on a vehicle chassis and a system for detecting proximate obstacles, the combination comprising:

the work platform including a control panel with operating components configured to control a position of the platform relative to the vehicle chassis;

a sensor mounted in a vicinity of the platform, the sensor configured to monitor at least one of an operator area, the platform, and an area around the platform;

a processor configured to receive a signal from the sensor, the processor configured to process the signal to determine at least one of a position of an operator on the platform and a proximity of objects in the area around the platform;

a control module configured to communicate with the processor and the operating components and configured to modify control signals from the control panel based on communication with the processor, wherein the processor is configured to determine that the operator is not present or is not in an operating position, and the control module is programmed to prevent operation of the platform indicated by the operating components that would cause motion of the platform; and an override switch connected with the control module, wherein the control module is programmed to permit continuous operation of the platform at creep speed based on activation of the override switch.

15. A combination of an aerial work platform secured on a vehicle chassis and a system for detecting proximate obstacles, the combination comprising:

the work platform including a control panel with operating components configured to control a position of the platform relative to the vehicle chassis;

a sensor mounted in a vicinity of the platform, the sensor configured to monitor at least one of an operator area, the platform, and an area around the platform;

a processor configured to receive a signal from the sensor, the processor configured to process the signal to determine at least one of a position of an operator on the platform and a proximity of objects in the area around the platform; and a control module configured to communicate with the processor and the operating components and configured to modify control signals from the control panel based on communication with the processor, wherein the sensor is programmed to distinguish the area around the platform between a warning zone and a danger zone, the danger zone being closer to the platform than the warning zone, wherein the processor is configured to determine that a warning zone object is present in the warning zone, and the control module is programmed to permit operation of the platform at creep speed based on the determination that the warning zone object is present in the warning zone, wherein the sensor is programmed to adaptively adjust a depth of at least one of the warning zone and the danger zone based on operating characteristics of the platform, wherein the processor is configured to determine that the operator is present and in an operating position and that there are no objects in the area around the platform, and the control module is programmed to permit operation of the platform.

16. A combination of an aerial work platform secured on a vehicle chassis and a system for detecting proximate obstacles, the combination comprising:

the work platform including a control panel with operating components configured to control a position of the platform relative to the vehicle chassis;

a sensor mounted in a vicinity of the platform, the sensor configured to monitor at least one of an operator area, the platform, and an area around the platform;

a processor configured to receive a signal from the sensor, the processor configured to process the signal to determine at least one of a position of an operator on the platform and a proximity of objects in the area around the platform; and a control module configured to communicate with the processor and the operating components and configured to modify control signals from the control panel based on communication with the processor, wherein the control module is configured to detect a speed of the platform, and wherein the processor is programmed to process signals from the sensor relating to the platform speed toward one of the objects in the area around the platform, the control module being programmed to slow active functions at a rate relative to the speed at which the platform is approaching the one of the objects in the area around the platform.

* * * * *